US005355652A

United States Patent [19]

Minas

[11] Patent Number: 5,355,652

[45] Date of Patent: Oct. 18, 1994

[54] SUSPENDED SURFACES FOR THE APPLICATION OF PLASTERS

[76] Inventor: Iosifides Minas, 14 Panagi Benaki, 114 71 Athens, Greece

[21] Appl. No.: 656,155

[22] PCT Filed: Oct. 19, 1990

[86] PCT No.: PCT/GR90/00004

§ 371 Date: Apr. 18, 1991

§ 102(e) Date: Apr. 18, 1991

[87] PCT Pub. No.: WO91/05928

PCT Pub. Date: May 2, 1991

[51] Int. Cl.[5] ..... E04G 21/00

[52] U.S. Cl. ..... 52/741.1; 52/405.3; 52/351; 52/404.3

[58] Field of Search ..... 52/741.1, 344, 351, 52/356, 407, 404

[56] References Cited

U.S. PATENT DOCUMENTS

| | | | |
|---|---|---|---|
| 4,019,296 | 4/1977 | Jochmann | 52/407 X |
| 4,277,926 | 7/1981 | Sherman et al. | 52/404 X |
| 4,422,271 | 12/1983 | Anzinger | 52/407 X |
| 4,566,238 | 1/1986 | Janopaul, Jr. | 52/407 |

FOREIGN PATENT DOCUMENTS

| | | |
|---|---|---|
| WO01550 | 2/1989 | European Pat. Off. . |
| 3136026 | 3/1983 | Fed. Rep. of Germany . |
| 2362253 | 3/1978 | France . |
| 2483992 | 12/1981 | France . |
| 2523620 | 9/1983 | France . |

*Primary Examiner*—Philip C. Kannan

[57] ABSTRACT

A method for the suspension of panels from a building, to form a final surface, on which plasters are to be applied, whereby the building consists of a load bearing structure and a curtain wall and has an outer surface, facing the panels, and covered with an insulating material. In accordance with the method, supports made of non-rusting material are clamped on the load bearing structure, to form at least one horizontal array of supports, whereby the supports project from the outer surface of the building and from the insulating material. The supports of each of the horizontal arrays are bridged by beam-member(s), whereby the connection between the supports of each horizontal array and the beam-members allows the beam-members to slide on the supports, so that to avoid the development of stresses in the beam-members as a result of temperature variations. Comb elements having teeth connected to stop means, penetrate the insulating material, to locate the comb element, so that the stop means projects from the insulating material. Then the panels are hung on the beam-members, in such a way so that adjacent panels overlap, whereby the stop means form an abutment for the panels to maintain them at a distance from the outer surface, the distance exceeding the thickness of the insulating material so that an air gap is formed. Finally the overlapping areas of the adjacent panels are fastened to each other, to form the final surface, on which the plasters are to be applied.

5 Claims, 4 Drawing Sheets

SUSPENDED SURFACES FOR THE APPLICATION OF PLASTERS

SUSPENDED SURFACES FOR THE APPLICATION OF PLASTERS

Figure 1:
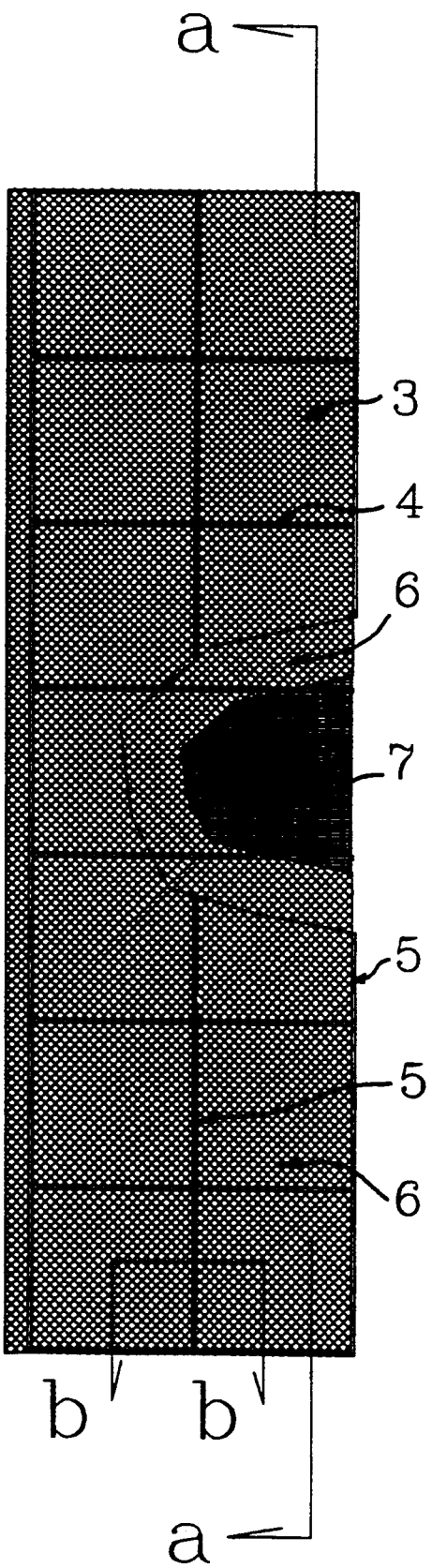

The present invention relates to a method for the suspension of panels from a building to form a final surface, on which plasters are to be applied.

According to the art of building construction, as reported in the pertinent literature, the plasters are applied on the walls as follows:

a) Directly on the surface of the main wall.

b) On surfaces of materials, which are directly attached to the single leaf walls, as for example on plates of insulation materials, metallic screen etc.. In the case, where plates of insulation materials are used, before the application of plasters the plates are reinforced with metallic, fiberglas or plastic screens.

c) Directly on the surface of the exterior wall, in the case of twin leaf walls with an air gap, four to six centimetres wide, between the two leafs, whereby the air gap may be filled with insulating material. It should be noted, that due to its small thickness, the brick wall constituting the exterior leaf, must be supported to the inner wall with ties and with concrete beams.

Further, document WO-89/01550 discloses a method to construct a surface covering a wall using brackets, which are mounted in a dense arrangement on the wall. In particular FIG. 15 of this document shows the rows of brackets 149 screwed in the wall, with insulating material 150 being suspended on the horizontal portion of the brackets. Subsequently beams are inserted into the hooks of the brackets to anchor the insulating material, and facade sheets 157 are attached by rivets on the outside of the beams in the way shown in FIG. 10 of the WO-document. With such a construction an air gap is formed between the insulating material and the facade sheet. It is noted that according to this method of construction the brackets transfer the loads which act on the panels, to the wall. Further the depth of the air gap thus formed, depends on the dimension of the web of the beams (see FIG. 10 of WO-document, beam 128) and subsequently the dimensions of the beams must be selected according to the thickness of the insulating material and the thickness of the air gap.

It would be desirable if there were available a method and the necessary means for the construction of panels covering the walls of the building, whereby the construction is on one hand simple and not time consuming and on the other hand the loads acting on the panels do not dangerously load the walls of the building.

The present invention provides a method for the suspension of panels from a building, to form a final surface, on which plasters are to be applied, whereby the building consists of a load bearing structure and a curtain wall and has an outer surface, which faces the panels, and which is covered with an insulating material. In accordance with the invention, supports made of non-rusting material are clamped on the load bearing structure of the building, to form at least one horizontal array of supports, whereby the supports project from the outer surface of the building and from the insulating material. The supports of each of the horizontal arrays are bridged by at least one beam-member made of non-rusting material, whereby the connection between the supports of each horizontal array and the beam-members bridging the supports allows the beam-members to slide on the supports, so that to avoid the development of stresses in the beam-members as a result of temperature variations. At least one comb element having teeth connected to stop means, penetrates the insulating material, to locate the comb element, so that the stop means projects from the insulating material. Then the panels are hung on the beam-members, in such a way so that adjacent panels overlap, whereby the stop means form an abutment for the panels to maintain them at a distance from the outer surface, the distance exceeding the thickness of the insulating material so that an air gap is formed. Finally the overlapping areas of the adjacent panels are fastened to each other, to form the final surface, on which the plasters are to be applied.

The advantages resulting from the use of the suspended surfaces are the following:

a) The plasters are not applied directly on the walls or on materials attached to them, but on the suspended surfaces, which are made of prefabricated panels. Thus the weight of the plasters do not dangerously load the walls.

b) The air gap between the wall and the suspended panel is uninterrupted and extends throughout the height of the building.

c) The suspended surfaces with the plasters applied on them, loose easily the thermal energy collected during the day, because of their light mass and the circulation of air they allow. Thus overheating of the plaster is avoided, even during summer time.

d) The construction of load bearing elements above openings, such as windows and doors, which is necessary when a second brick wall is built to form a twin leaf wall with an air gap between the two leafs, is eliminated.

e) The proposed construction is relatively cheap.

f) The suspended panels with the plaster applied on them result in a construction, which is lighter and thinner than regular twin leaf walls, because of the omission of the exterior brick wall and the reduction of the thickness of the air gap.

g) Foundations or any other supports, necessary in the construction of exterior leaf of regular twin leaf brick walls, are not needed.

h) Suspended plasters suffer less damages than usual plasters in cases of soil movements or in cases of earthquakes.

i) A complete coverage of the building walls may be achieved without thermally bridging the walls with the suspended surfaces.

j) The insulating material is free from loading, because the heavy inorganic plaster is applied on the suspended surface.

One way of carrying out the invention is described in detail below with reference to drawings wherein:

FIG. 1. shows the front face of a single panel which constitutes the suspended surface on which the plaster is going to be applied.

Figure 2:
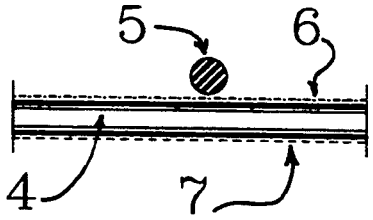

FIG. 2. shows the cross section B—B of the panel of FIG. 1, in different scale from that of FIG. 1.

Figure 3:
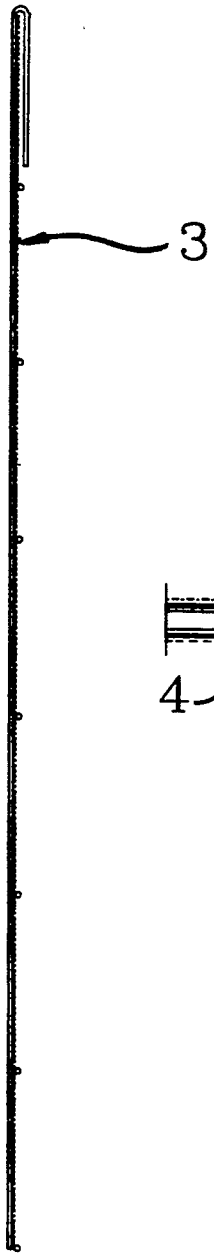

FIG. 3. shows the cross section of A—A of the panel, of FIG. 1.

Figure 4:
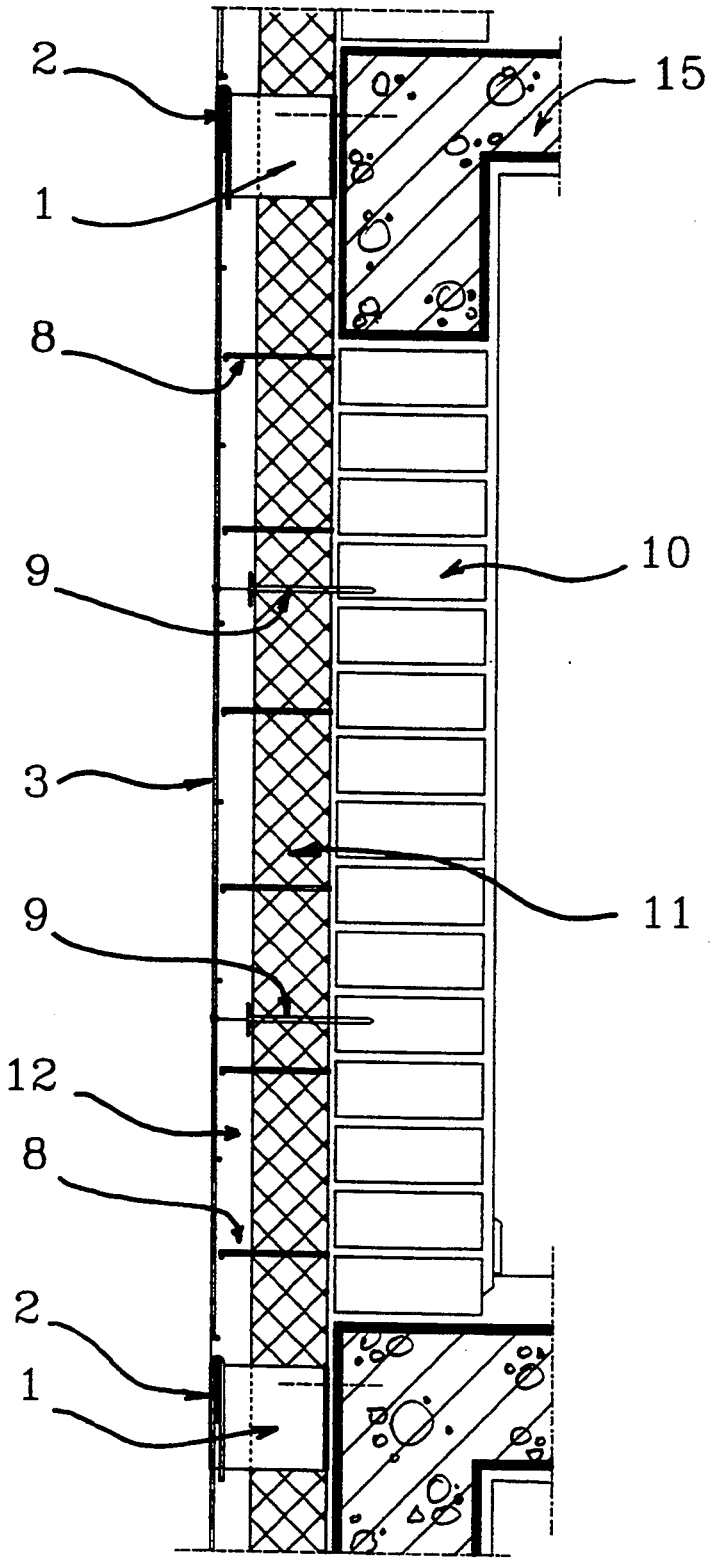

FIG. 4. shows the cross section of the final construction consisting from the main wall, a layer of insulating material, the air gap, the suspended surface and the elements for the support and fastening of the latter.

Figure 5:
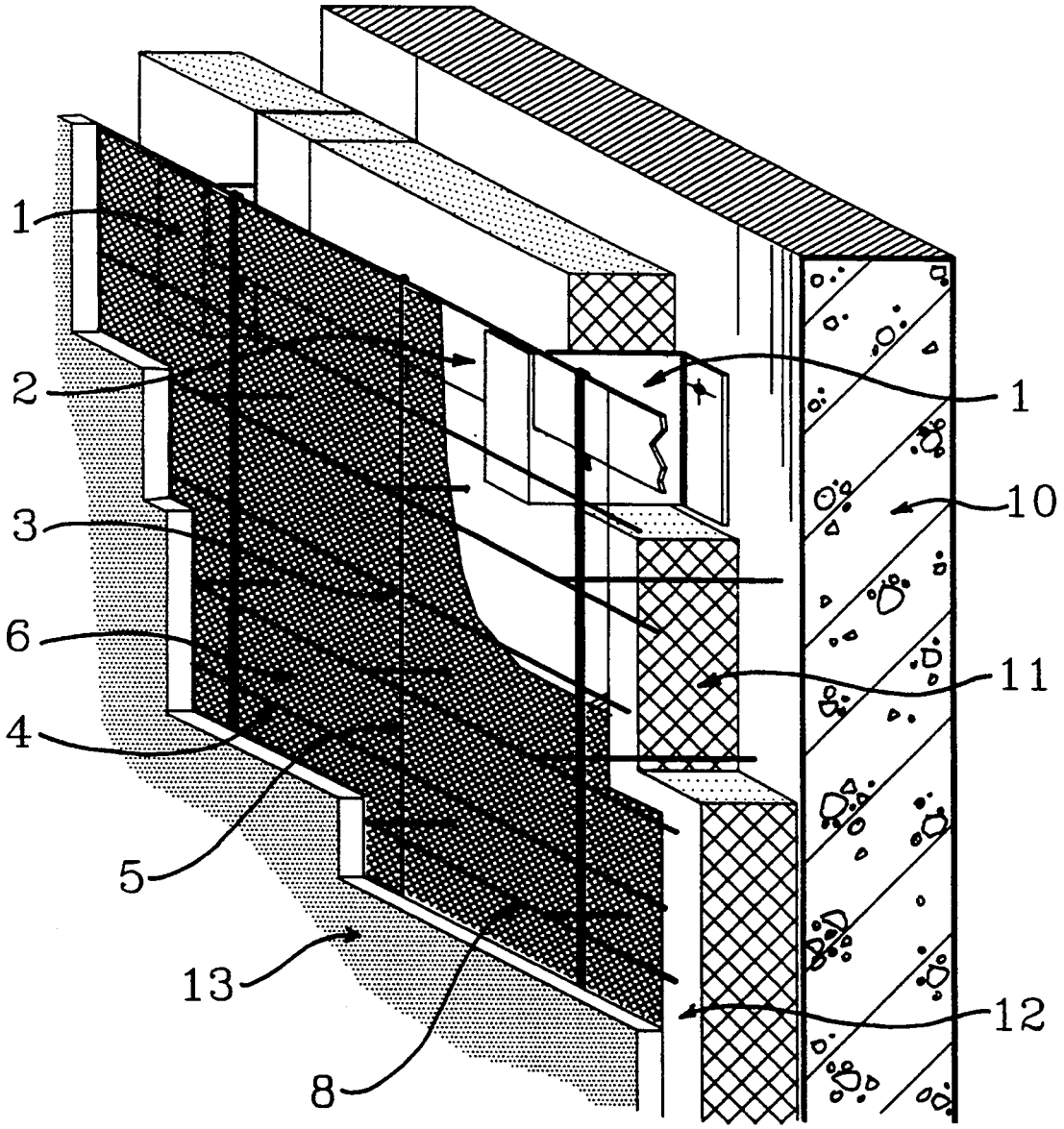

FIG. 5. shows axonometrically the hanging of the panel on the beam, which is supported on supports, and the gap retainer combs.

Figure 6:
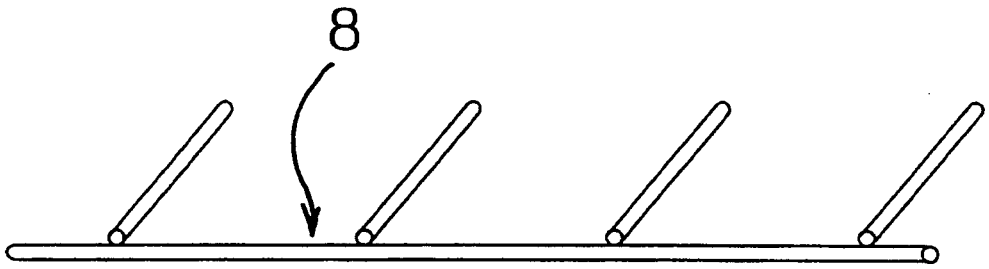

FIG. 6. shows a part of the comb element that maintains the panel at a distance from the building wall.

Figure 7:
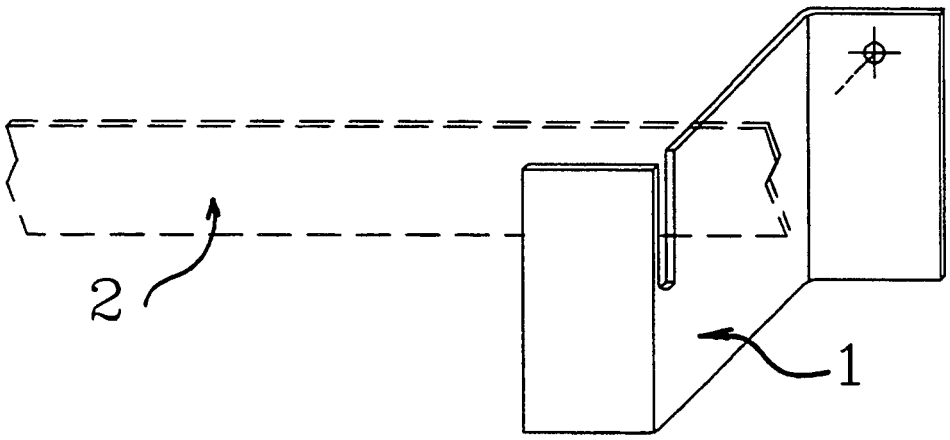

FIG. 7. shows the beam (broken line), which is inserted in the groove at the free of the end of the support.

The panel 3 is hung on the beam 2, which is supported on the free ends of the support 1 clamped to the concrete floor 15 as shown in FIG. 4. Assemblage of the individual panels 3 will provide the final suspended surface on which the plaster 13 is going to be applied. Before hanging the panels 3, comb elements 8 are placed by penetrating the insulating material 11, to support the panels from wind or other mechanical pressures applied towards the wall 10. In order to protect the panels from outward pressures, the panels are fastened with galvanised wire, in several points, to support elements 9, which are provided to support the insulating material 11 to the wall 10.

FIG. 1 shows the panel 3 having a screen 6 extended out of the one, the long, side of the panel 3 to form a narrow ribbon, that overlaps with the adjacent panel. Overlapping areas of adjacent panels 3 are stitched with a thin galvanised wire.

The lower end of the panels are fastened with galvanised wire to the supports and to the beams, on which the panels corresponding to the storey below are hung, if such a storey exists. This arrangement is shown in FIG. 4.

The main components of the panels, as shown in FIG. 2, are the horizontal 4 and the vertical 5 reinforcement, the screen 6, and the plaster barrier 7.

What is claimed is:

1. A method for the suspension of panels from a building, to form a final surface, on which final surface plasters are to be applied, the building consisting of a load bearing structure and a curtain wall, whereby the building has an outer surface, which faces the panels, and which is covered with an insulating material, the method comprising the following steps:

(a) clamping supports made of non-rusting material on the load bearing structure, to form at least one horizontal array of supports, whereby the supports project from the outer surface of the building and from the insulating material, (b) bridging the supports of each of the horizontal arrays by at least one beam-member made of non-rusting material, whereby the connection between the supports of each horizontal array and the beam-members bridging the supports allows the beam-members to slide on the supports, so that to avoid the development of stresses in the beam-members as a result of temperature variations, (c) providing at least one comb element having teeth connected to stop means, and penetrating the insulating material with the teeth to locate the comb element, so that the stop means projects from the insulating material, (d) hanging the panels on the beam-members, the panels being hung in such a way so that adjacent panels overlap, whereby the stop means form an abutment for the panels to maintain them at a distance from the outer surface, the distance exceeding the thickness of the insulating material so that an air gap is formed, (e) fastening the overlapping areas of the adjacent panels to each other, to form the final surface, on which the plasters are to be applied.

2. The method of claim 1, whereby the load bearing structure comprises concrete floors, and the supports are clamped along the edge of the concrete floors.

3. The method of claim 1, including prefabricating the panels wherein the panels consist of a main reinforcement made of rods, a secondary reinforcement screen having an extension to overlap the adjacent panels, and a plaster barrier, which cannot be penetrated by plaster.

4. The method of claim 3, whereby the plaster barrier is formed by the secondary reinforcement screen.

5. The method of claim 1, including providing grooves in the supports to receive and support the at least one beam member.

* * * * *

UNITED STATES PATENT AND TRADEMARK OFFICE

CERTIFICATE OF CORRECTION

PATENT NO. : 5,355,652

DATED : October 18, 1994

INVENTOR(S) : Minas Iosifides

It is certified that error appears in the above-identified patent and that said Letters Patent is hereby corrected as shown below:

On the title page, inventor should read

--(76) Inventor: Minas Iosifides--.

Signed and Sealed this

Twenty-seventh Day of December, 1994

*Attest:*

Bruce Lehman

BRUCE LEHMAN

*Attesting Officer*

*Commissioner of Patents and Trademarks*